US006244937B1

(12) United States Patent
Jaskowiak et al.

(10) Patent No.: US 6,244,937 B1
(45) Date of Patent: Jun. 12, 2001

(54) GRINDING WHEEL WITH GEOMETRICAL PATTERN

(75) Inventors: Timothy R. Jaskowiak, Webster; Grethel K. Mulroy, Pittsford; Thomas L. DiGravio, Ontario, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/603,032

(22) Filed: Jun. 23, 2000

Related U.S. Application Data

(62) Division of application No. 09/145,813, filed on Sep. 2, 1998, now Pat. No. 6,120,356.

(51) Int. Cl.[7] ..... B24B 49/04

(52) U.S. Cl. ..... 451/51; 451/41; 451/49; 451/164

(58) Field of Search ..... 451/41, 49, 51, 451/124, 150, 164, 165, 178, 546, 547, 910

(56) References Cited

U.S. PATENT DOCUMENTS

| | | | |
|---|---|---|---|
| 2,525,591 | 10/1950 | Cotchett | 451/49 X |
| 3,073,690 | 1/1963 | Hollis et al. | 451/547 X |
| 3,273,288 | 9/1966 | Kuris et al. | 451/178 |
| 3,468,583 | 9/1969 | Austin | 451/547 X |
| 3,878,650 | 4/1975 | Klotzbach | 51/101 R |
| 3,882,641 | 5/1975 | Montgomery et al. | 51/73 R |
| 3,898,772 | 8/1975 | Sawluk | 51/206 P |
| 4,037,367 | 7/1977 | Kruse | 51/209 S |
| 4,361,986 | 12/1982 | van der Linden | 51/34 R |
| 4,411,250 | 10/1983 | Lach | 125/11 CD |
| 4,524,543 | 6/1985 | Inoue | 51/34 R |
| 4,580,370 | 4/1986 | Smith | 51/289 R |
| 4,685,440 | 8/1987 | Owens | 125/11 CD |
| 4,709,508 | 12/1987 | Junker | 51/105 R |
| 4,766,700 | 8/1988 | Kramberg et al. | 51/165.74 |
| 4,773,187 | 9/1988 | Ohta et al. | 51/165.77 |
| 4,841,682 | 6/1989 | Waelti | 51/289 R |
| 4,915,089 | 4/1990 | Ruark et al. | 125/11 CD |
| 5,113,624 | 5/1992 | Dawson | 51/325 |
| 5,746,643 | 5/1998 | Terasaki et al. | 451/5 |

*Primary Examiner*—Joseph J. Hail, III
*Assistant Examiner*—Anthony Ojini
(74) *Attorney, Agent, or Firm*—Andrew D. Ryan

(57) ABSTRACT

A vibration inducing grinding wheel for removing material from a workpiece is provided. The vibration inducing grinding wheel is for use in a grinding machine. The vibration inducing grinding wheel includes a generally cylindrically shaped body defining a cylindrical outer periphery thereof. At least one of the composition and the contour of the outer periphery is selected so as to provide a vibration to the grinding machine such that the straightness of the workpiece is thereby improved with respect to the straightness of the workpiece ground by a standard grinding wheel having a cylindrical outer periphery thereof, the contour and composition of the outer periphery of the standard grinding wheel being uniform.

14 Claims, 7 Drawing Sheets

GRINDING WHEEL WITH GEOMETRICAL PATTERN

This application is a divisional of application Ser. No. 09/145,813, filed Sep. 2, 1998, now U.S. Pat. No. 6,120,356.

The present invention relates to grinding wheels. More specifically, the invention relates to grinding wheels for grinding long slender shafts and a process therefore.

Cross reference is made to the following application filed concurrently herewith: U.S. patent application Ser. No. 09/146,207, entitled "Non-Contact Support for Cylindrical Machining", by Grethel K. Mulroy et al.

To obtain precision parts for machines and other equipment, machining of the work surfaces of the components of parts of a machine are often required. To obtain high precision surfaces of parts and, in particular, to obtain precision surfaces for hard parts, for example ceramic or heat-treated steel parts, the work surfaces are machined by a hard, abrasive surface. For cylindrical workpieces the cylindrical outer periphery is often machined by simultaneously rotating the cylindrical part while rotating a cylindrical abrasive wheel. The part or workpiece is thus ground on a grinding machine.

The grinding of cylindrical parts is typically accomplished in one of two methods. In the first method, the workpiece is rotated about centers formed on the ends of the workpiece. Pressure on the workpiece centers or a drive dog attached to the workpiece is used to rotate the workpiece utilizing a motor in the head stock of the grinder. A grinding wheel having a generally cylindrical form is rotated by a grinding wheel spindle and driven by typically an electric motor. The periphery of the grinding wheel contacts the periphery of the rotating workpiece thereby performing the precision grinding of the periphery of the workpiece. This process is typically called cylindrical grinding.

Such grinding occurs by typically one of two processes, namely plunge grinding and traverse grinding. When utilizing plunge grinding, the grinding wheel is advanced toward the workpiece until the finished precision surface is obtained. In traverse grinding, the grinding wheel is brought into contact with the workpiece and caused to traverse in a direction parallel to the center line of the workpiece in a series of reciprocating motion until the final workpiece configuration is obtained.

One other type of cylindrical grinding is centerless grinding in which the workpiece is supported on the periphery of the workpiece in at least two places. For example, the workpiece is supported by a rest blade and a regulating wheel. The workpiece is contained within three different elements, the rest blade, the regulating wheel, and the grinding wheel.

As with cylindrical grinding, in centerless grinding, the grinding wheel may plunge into the workpiece until the final workpiece configuration is obtained or the grinding wheel may traverse along the axis of the workpiece until the final configuration of the workpiece is obtained.

The force of the grinding wheel against the workpiece during the grinding process creates a force upon the workpiece a portion of which is perpendicular to the workpiece contact surface causing the workpiece to deflect during the grinding process.

The deflection of the workpiece during grinding is a particular problem for precision, long or slender shafts. The deflection of the workpiece during the grinding may cause difficulty in obtaining precision size as the deflection during grinding changes with feed rates and grinding wheel configurations, as well as, with variations from workpiece to workpiece. Furthermore, surface conditions such as roundness, waviness, runout, cylindricity, as well as chatter, may become problems and are aggravated by the vibration from the grinder that may be transferred to the workpiece due to the deflection of the long, slender workpiece during the grinding process.

Long slender shafts are used extensively in machines that pass a substrate through the machine. For example, copy and printing machines pass either a series of cut sheets or a roll of substrate through the machine. The sheets or rolls are guided by long slender shafts and the work performed on the sheets and rolls are performed on long slender shafts. It should be appreciated that other types of machinery also use long slender rotating shafts to perform work.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface.

Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

While shafts in electrophotographic printing for guiding substrates require accurate tolerances and may be long and slender, exasperating the accurate tolerance problems, the difficulties encountered in providing accurate donor rolls for scavengeless development systems is particularly acute.

In a scavengeless development system, toner is detached from the donor roll by applying AC electric field to self-spaced electrode structures, commonly in the form of wires positioned in the nip between a donor roll and photoreceptor in the case of hybrid scavengeless development or by applying the AC electrical field directly to the donor roll in the case of hybrid jumping development. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

Since hybrid scavengeless development relies on a continuous, steady toner powder cloud at the nip between the latent image and the donor roller and since the speeds at which the rollers operate in these complex machines may be very fast and the accuracy requirements of these rollers are quite precise.

The purpose and function of scavengeless development are described more fully in, for example, U.S. Pat. No. 4,868,600 to Hays et al., U.S. Pat. No. U.S. Pat. No. 4,984,019 to Folkins, U.S. Pat. No. 5,010,367 to Hays, or 5,063,875 to Folkins et al. U.S. Pat. No. 4,868,600 is incorporated herein by reference.

Developer or donor rolls utilized in the hybrid scavengeless development process typically have long slender diameters. For example, donor rolls may have lengths of approximately 19 inches and diameters of say, for example, 1.25 inches. The donor rolls may be made of anodized aluminum or ceramics. When manufactured from ceramics, the donor rolls are quite hard and very difficult to machine.

The donor rolls in hybrid scavengeless development require exacting tolerances to provide for accurate development of the latent image on the photoconductor and to avoid arcing or related problems. Donor rolls for hybrid scavengeless development may require exacting tolerances. For example, the donor rolls may require a runout having a total indicator runout (TIR) of say, for example, 20 microns, diameter of tolerances of, for example, in the order of several microns and surface finish in the single micron range.

In addition, due to vibrations in the grinding machine, the wheel and the workplace, the donor rolls machined thereby tend to have a wavy outer periphery when measured along the periphery in a direction parallel to the center line of the rolls. This wavy pattern on the surface is typically of a sinusoidal nature and may be described by a peak-to-valley dimension of $W_T$. The dimension $W_T$ may be particularly difficult to improve as the reduction of the vibratory effect on the rolls is very difficult to minimize. The dimension $W_T$ influences the straightens of the donor roll. Straightens is the measure of the difference between two parallel lines which are formed between the inner and outer dimension of the periphery of the roll and which are parallel to the longitudinal axis of the roll.

The following disclosures may be relevant to various aspects of the present invention:

U.S. Pat. No. 5,113,624

Patentee: Dawson

Issue Date: May 19, 1992

U.S. Pat. No. 4,915,089

Patentee: Ruark et al.

Issue Date: Apr. 10, 1990

U.S. Pat. No. 4,685,440

Patentee: Owens

Issue Date: Aug. 11, 1987

U.S. Pat. No. 4,580,370

Patentee: Smith

Issue Date: Apr. 8, 1986

U.S. Pat. No. 4,411,250

Patentee: Lach

Issue Date: Oct. 25, 1983

U.S. Pat. No. 4,037,367

Patentee: Kruse

Issue Date: Jul. 26, 1977

U.S. Pat. No. 3,882,641

Patentee: Montgomery, et al.

Issue Date: May 13,1975

U.S. Pat. No. 3,878,650

Patentee: Klotzbach

Issue Date: Apr. 22, 1975

The relevant portions of the foregoing disclosures may be briefly summarized as follows:

U.S. Pat. No. 5,113,624 discloses a method of cross-grinding a non-planar surface on a workpiece, of a non-metallic material having a Vickers hardness value up to 5000, comprises, in each of two grinding steps, traversing the rotational axis of a grinding wheel along a predetermined axis, relative to the workpiece surface. In the first step the radially extending plane of the grinding wheel includes the predetermined axis, and the required workpiece surface is produced with inevitable ridges. For the second grinding step the working surface of the same, or different, grinding wheel is shaped by a tool capable of shaping in a normal manner the working surface suitable for the first grinding step. However, the working surface of the grinding wheel is altered by the radially extending plane of the wheel when presented to the tool being inclined in one sense at a selected angle, in the range 1o to 20o, to the direction of this plane if presented to the tool to obtain the shape suitable for the first grinding step. In the second grinding step the ridges on the workpiece are reduced by the radially extending plane of the wheel with the altered working surface being inclined in the one sense at the selected angle to the orientation of the radially extending plane of the grinding wheel in the first grinding step.

U.S. Pat. No. 4,915,089 discloses a tool for truing and dressing a grinding wheel, comprising a wheel having a thin layer of diamonds in a plane perpendicular to the rotational axis of the tool. There is also provided a method for truing and dressing a grinding wheel, comprising engaging the periphery of a rotating grinding wheel with a rotating truing and dressing wheel having a thin layer of diamonds in a plane perpendicular to the rotational axis of the truing and dressing wheel. Preferably, the truing and dressing wheel is disposed between the headstock and tailstock of a grinding machine in place of the workpiece.

U.S. Pat. No. 4,685,440 discloses an apparatus and method to provide a rotary dressing tool, formed to the geometric shape of any part piece to be ground, which is utilized to reform an abrasive wheel so that it will produce desired dimensional characteristics on the part piece. A combination of diamond particles and preformed polycrystalline diamond segments are spaced around the outer perimeter of the tool and surrounded by a matrix of abrasive resistant nickel based alloy. Co-utilization of the diamond particles and the preformed segments creates a rotary dressing tool which is highly resistant to abrasive wear, enhancing the performance and durability of the tool.

U.S. Pat. No. 4,580,370 discloses a centerless grinding system comprises a driven grinding wheel, a driven regulating wheel, and a work rest blade for centerless grinding of a workpiece supported by the work rest blade between the grinding wheel and the regulating wheel; means for determining the rate of reduction of the workpiece radius while it is being ground; and means responsive to the rate of reduction of the workpiece radius for controlling the ratio of the power consumed in removing workpiece material to the rate of removal of workpiece material by the grinding wheel. The regulating wheel is preferably fed toward the grinding wheel to feed the workpiece into the grinding wheel. In a similar center-type grinding system, the workpiece is mounted on spindles or chucks which are movable toward the grinding wheel so that the workpiece can still be fed by the regulating wheel. Workpieces longer than the axial dimension of the grinding wheel are ground in successive plunges along the length of the workpiece, with the ratio being controlled in each successive plunge. To grind hollow workpieces, the regulating wheel or grinding wheel is placed inside the hollow workpiece.

U.S. Pat. No 4,411,250 discloses a truing tool with a profile being composed of profiled plates formed of hard or super hard material, which are arranged in spaced relation to each other. The hard material is preferably polycrystalline, synthetic diamond processed by means of spark erosion. The truing tool may be in the form of a roller consisting of segments spaced from each other on the circumferential surface of a shaft body, with profiled plates being arranged on the breast surfaces of the segments.

U.S. Pat. No. 4,037,367 discloses a rotary tool adapted for grinding under a flowing liquid film, wherein the particles of abrasive are metal-bonded to a rigid supporting surface, the improvement consists of a network in the supporting surface of grooves having constant depth and constant width and traversing the supporting surface to provide a continuum of centrifugal drainage grooves in the radial direction thereby subdividing the supporting surface into working elements. The ratio of the total area (A[E]) of the working elements to the total area (A[G]) of the network of grooves: A[E]/A[G] is at least 1.5. The configuration of the network of grooves is selected such that the angle of intersection of any side of any channel with the radius at any point is an acute angle between 0° and 75.

U.S. Pat. No. 3,882,641 discloses a cabochon gem grinding machine comprising a drum having a cylindrical wall and a lip extending inwardly from the sides of the wall for retaining a slurry of abrasive grain or grit, a pair of rollers which support and rotate the drum to distribute and maintain the slurry against the inner wall of the drum by centrifugal force, a dope for holding a gem to be ground in contact with the slurry at a desired angle to the vertical to grind a desired area of the gem, a pattern for indicating the desired shape of the gem, and a drive mechanism for rotating the gem and the pattern and for moving them toward a vertical position to grind new areas of the gem. Also, sensing and actuating apparatus is provided for detecting when a gem area has been ground to the desired size and for rotating the gem and pattern and for moving them toward vertical position to grind new areas of the gem. Also, sensing and actuating apparatus is provided for detecting when a gem area has been ground to the desired size and for rotating the gem and pattern and for moving them toward vertical position to grind new areas of the gem. A method of grinding cabochons and the like, comprising maintaining a slurry of abrasive material inside a rotating drum, holding a gem to be ground in contact with the slurry at a desired angle to the vertical to grind a desired area of the gem, rotating the gem and moving it toward the vertical when the gem area has been ground to the desired size, and repeating the steps until the gem has been ground to the desired pattern.

U.S. Pat. No. 3,878,650 discloses a glass grinding machine for dressing the edges of glass windowpanes is provided comprising a motor-driven turntable having releasable clamping means automatically coordinated with the movement of the turntable for holding the windowpanes during grinding thereof; a working station provided at the periphery of the turntable and having a rotating grinding wheel movably mounted and controlled by a template guiding means corresponding to a predetermined contour; a feed station provided at the turntable periphery and having feed means automatically coordinated with the turntable movement for depositing the windowpanes continuously fed for the grinding operation into one of the clamping means; a removal station provided at the turntable periphery and having removal means operating automatically in coordination with the turntable movement for the removal of the ground windowpanes from one of the clamping means, the feed and removal means having a swinging arm drive in coordination with the turntable and provided with means for holding one windowpane each; a swinging arm mounted for rotation about the axis of rotation of the turntable and having on its free end extending beyond the radius of the turntable a rotatably mounted beam having both of its ends positioned at a feed station and at a removal station, respectively, when the beam is oriented radially with regard to the turntable, the beam being equipped with glass pane holding means, a driver connected with the turntable shaft to produce a temporary synchronization of the swinging arm and turntable; a drive for rotating the beam by 180° about its axis of rotation on the swinging arm; and a rotary drive for rotating the swinging arm independently of the synchronization of the turntable and swinging arm at a velocity exceeding the speed of rotation of the turntable.

SUMMARY OF THE INVENTION

According to the present invention, there is provided a vibration inducing grinding wheel for removing material from a workpiece. The vibration inducing grinding wheel is for use in a grinding machine. The vibration inducing grinding wheel includes a generally cylindrically shaped body defining a cylindrical outer periphery thereof. At least one of the composition and the contour of the outer periphery is selected so as to provide a vibration to the grinding machine such that the straightness of the workpiece is thereby improved with respect to the straightness of the workpiece ground by a standard grinding wheel having a cylindrical outer periphery thereof, the contour and composition of the outer periphery of the standard grinding wheel being uniform.

According to the present invention there is further provided a method for grinding the cylindrical periphery of cylindrical workpieces on a grinding machine. The method includes the steps of providing a vibration inducing grinding wheel with a generally cylindrically shaped body defining a cylindrical outer periphery thereof, selecting at least one of the composition and the contour of the outer periphery of the vibration inducing grinding wheel so as to provide a vibration to the grinding machine such that the straightness of the workpiece is thereby improved, rotatably mounting the vibration inducing grinding wheel to the grinding machine, placing the workpiece adjacent the grinding machine in a rotatable position, advancing one of the workpiece and the vibration inducing grinding wheel into contact with the other of the workpiece and the grinding wheel, and grinding the workpiece with the vibration inducing grinding wheel such that the straightness of the workpiece is thereby improved with respect to the straightness of the workpiece ground by a standard grinding wheel having a cylindrical outer periphery thereof, the contour and composition of the outer periphery of the standard grinding wheel being uniform.

According to the present invention there is further provided a roll made by the process of providing a vibration inducing grinding wheel with a generally cylindrically shaped body defining a cylindrical outer periphery thereof, selecting at least one of the composition and the contour of the outer periphery of the vibration inducing grinding wheel so as to provide a vibration to the grinding machine such that the straightness of the workpiece is thereby improved, rotatably mounting the vibration inducing grinding wheel to the grinding machine, placing the workpiece adjacent the grinding machine in a rotatable position, advancing one of the workpiece and the vibration inducing grinding wheel into contact with the other of the workpiece and the grinding wheel, and grinding the workpiece with the vibration inducing grinding wheel such that the straightness of the workpiece is thereby improved with respect to the straightness of the workpiece ground by a standard grinding wheel having a cylindrical outer periphery thereof, the contour and composition of the outer periphery of the standard grinding wheel being uniform.

According to the present invention there is further provided a grinding machine for use in grinding a workpiece. The grinding machine includes a frame and a vibration inducing grinding wheel rotatably mounted to the frame. The vibration inducing grinding wheel includes a generally cylindrically shaped body defining a cylindrical outer periphery thereof. At least one of the composition and the contour of the outer periphery of the vibration inducing grinding wheel is selected so as to provide a vibration to the grinding machine such that the straightness of the workpiece is thereby improved with respect to the straightness of the workpiece ground by a standard grinding wheel having a cylindrical outer periphery thereof, the contour and composition of the outer periphery of the standard grinding wheel being uniform. The grinding machine also includes a motor for rotating the grinding wheel.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 7 printing machine will be shown hereinafter schematically and their operation described briefly with reference thereto.

Figure 8:
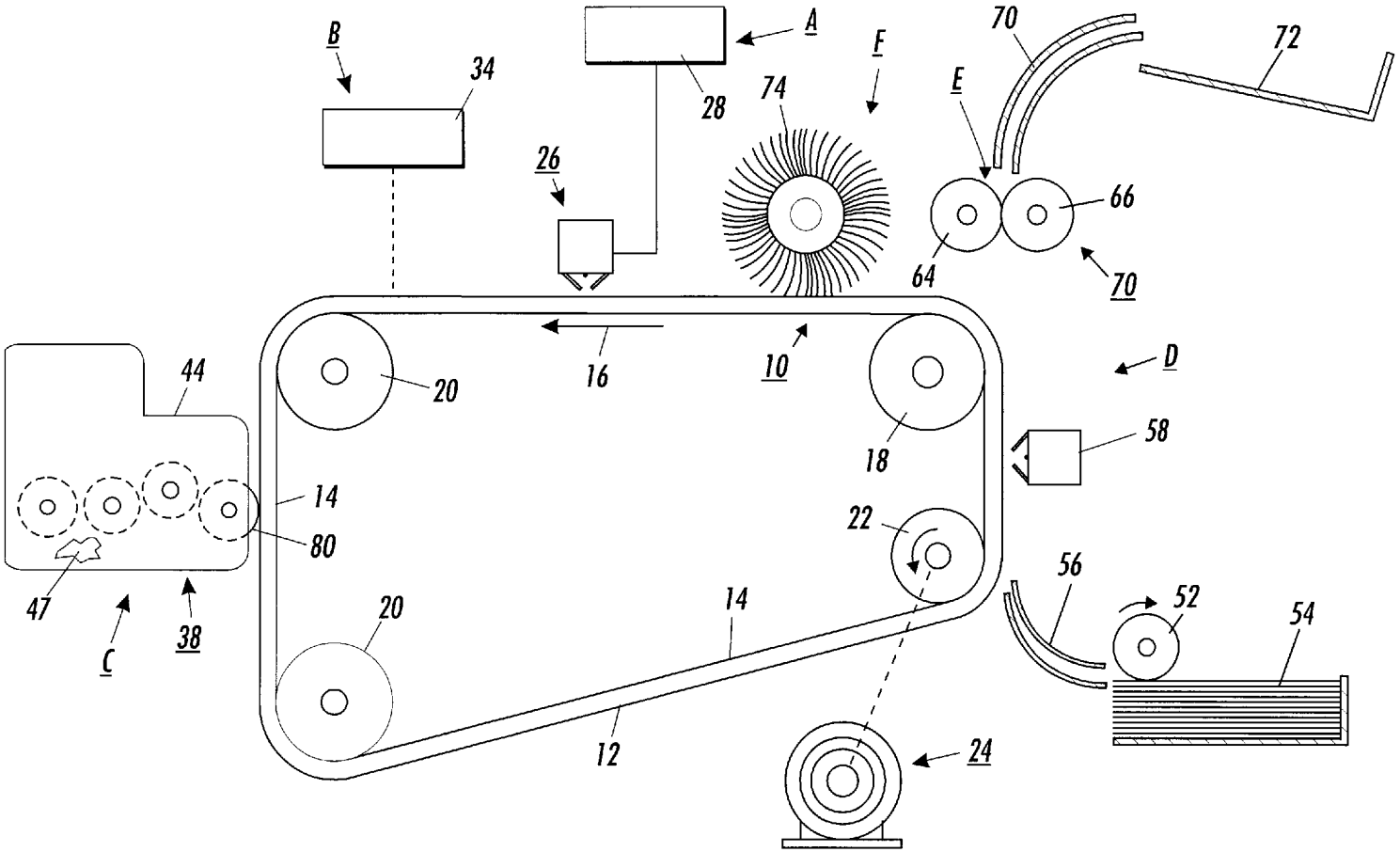
FIG. 8 is a schematic elevational view of an illustrative electrophotographic printing machine incorporating a roll ground with a wheel utilizing the geometrical shape of the present invention therein.

Referring initially to FIG. 8, there is shown an illustrative electrophotographic printing machine incorporating a donor roll ground on a grinding machine with a wheel utilizing the geometrical shape of the present invention of the present invention therein. The printing machine incorporates a photoreceptor 10 in the form of a belt having a photoconductive surface layer 12 on an electroconductive substrate 14. Preferably, the surface 12 is made from a selenium alloy or a suitable photosensitive organic compound. The substrate 14 is preferably made from a polyester film such as Mylar® (a trademark of duPont (UK) Ltd.) which has been coated with a thin layer of aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

Next, the charged portion of photoconductive surface 12 is advanced through exposure station B. At exposure station B, the ROS 34 lays out the image in a series of horizontal scan lines with each line having a specified number of pixels per inch. The ROS includes a laser and a rotating polygon mirror block associated therewith. The ROS exposes the charged photoconductive surface of the printer.

After the electrostatic latent image has been recorded on photoconductive surface 12, the motion of the belt 10 advances the latent image to development station C as shown in FIG. 8. At development station C, a development system 38, develops the latent image recorded on the photoconductive surface. The chamber in developer housing 44 stores a supply of developer material 47. The developer material 47 may be, as shown in FIG. 8, a two component developer material of at least magnetic carrier granules 48 having toner particles 50 adhering triboelectrically thereto. It should be appreciated that the developer material may likewise comprise a one component developer material consisting primarily of toner particles. Preferably the development system is a hybrid scavangeless development system. In a scavengeless development system, toner is detached from a donor roll 80 by applying AC electric field to self-spaced electrode structures (not shown), commonly in the form of wires positioned in the nip between the donor roll 80 and the photoreceptor belt 10 in the case of hybrid scavengeless development or by applying the AC electrical field directly to the donor roll 80 in the case of hybrid jumping development. This forms a toner powder cloud in the nip and the latent image attracts toner particles 50 from the powder cloud thereto.

Again referring to FIG. 8, after the electrostatic latent image has been developed, the motion of the belt 10 advances the developed image to transfer station D, at which a copy sheet 54 is advanced by roll 62 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 7:
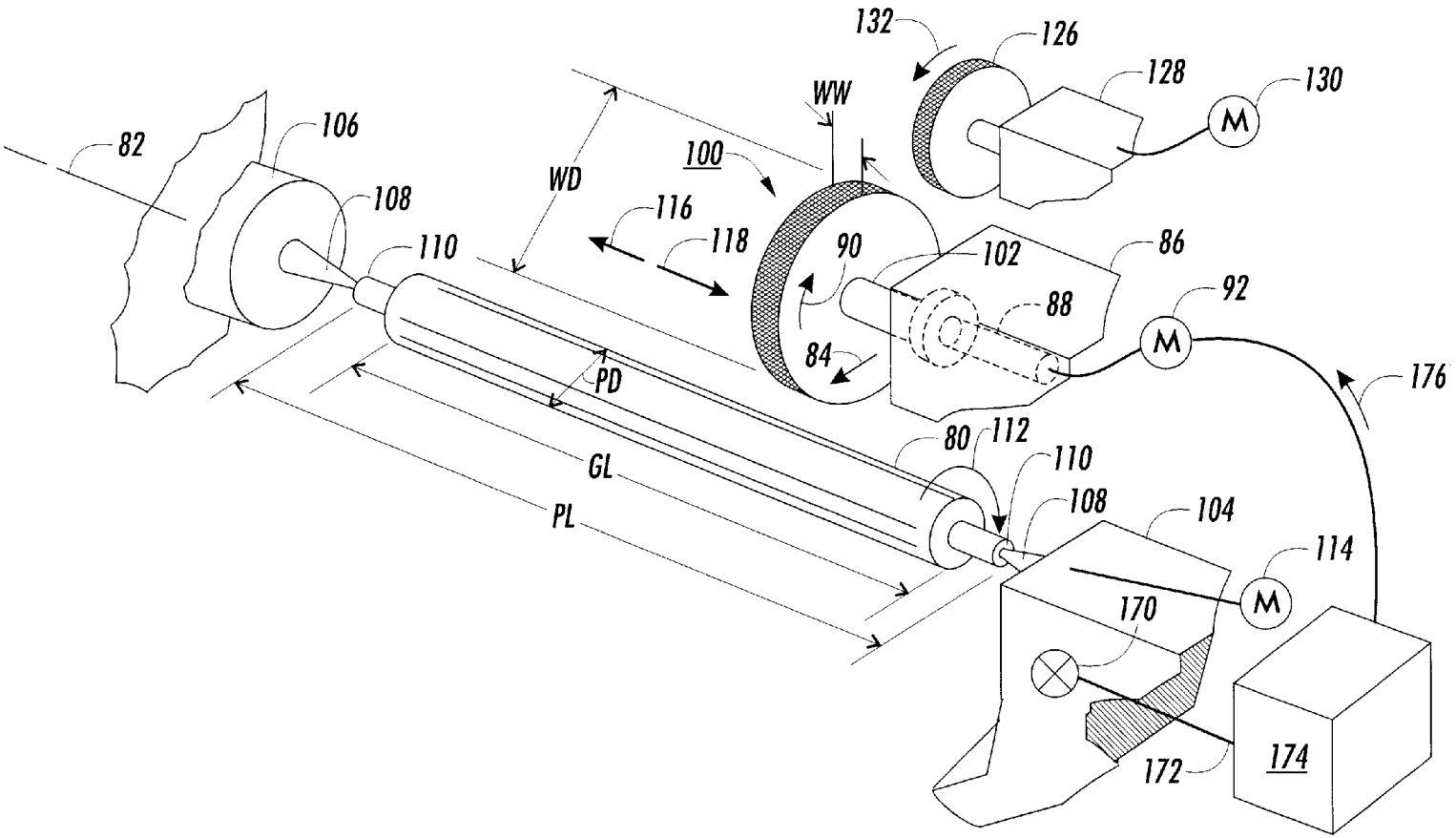
FIG. 7 is a perspective view of a grinding machine utilizing the grinding wheel with a geometrical shape according to the present invention.

Referring again to FIG. 8, a donor roll 80 which may be manufactured with a grinding wheel utilizing the geometrical pattern of the present invention, is shown as part of development system 38 to apply development material 47 onto the photoconductive belt 10 of the printing machine as shown in FIG. 7.

Referring now to FIG. 7, a grinding wheel 100 with geometrical pattern according to the present invention, is shown being utilized to grind the donor roll 80.

The grinding wheel 100, according to the present invention, may be utilized on any type of grinding machine capable of grinding the donor roll 80. For example, the grinding wheel 100 may be mounted on either a center-type or a centerless grinder. When utilizing a center-type grinding, the grinding wheel 100 may have a width WW which is as large as the grinding width GL of the donor roll 80 or as shown in FIG. 7, have a width WW which is significantly less than the grinding length GL. When the grinding wheel width WW is less than the grinding length GL, the grinding wheel 100 or the donor roll 80 moves in a direction parallel to rotational axis 82 of the donor roll 80. Conversely, if the grinding wheel 100 has a width WW at least as long as the grinding length GL of the donor roll 80, the grinding wheel merely moves or plunges inwardly in the direction of arrow 84 toward the donor roll 80.

The grinding machine may alternatively be a centerless-type grinder, including a regulating wheel (not shown) and a rest blade (not shown) with the donor roll 80 being positioned between the rest blade, the grinding wheel 100, and the regulating wheel.

Figure 2:
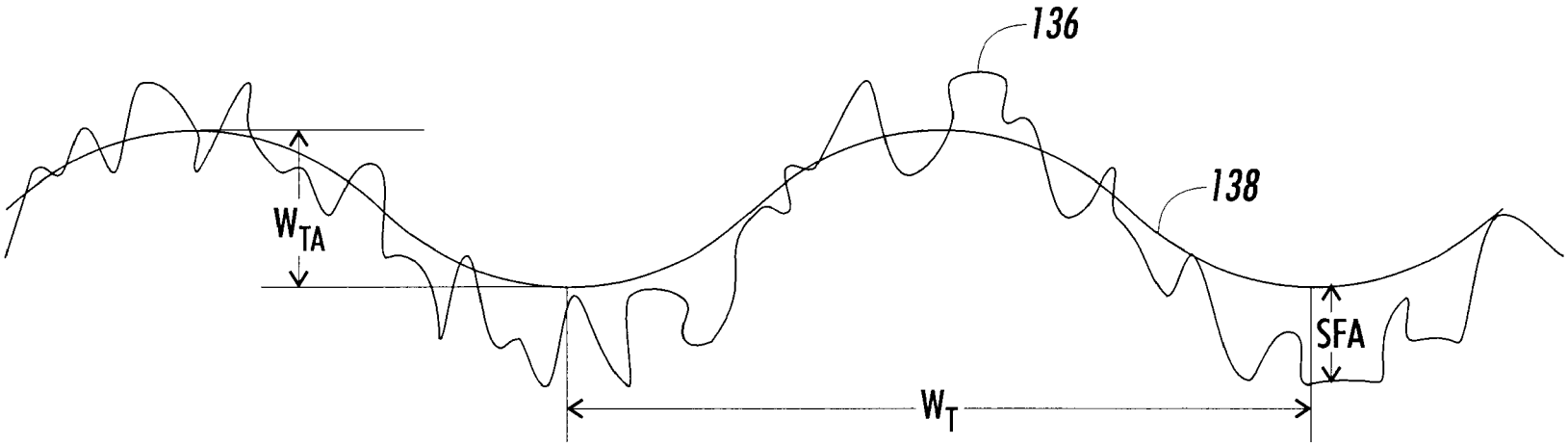
FIG. 2 Prior Art
FIG. 2 is a schematic view of the surface of a roll with the surface irregularities exaggerated ground by a grinding wheel depicting the introduction of noise into the grinding process utilizing a grinding wheel with a geometrical shape according to the present invention.

As shown in FIG. 2, the grinding wheel 100 may be mounted onto grinding machine 86 in the form of a center-type grinder. The grinding machine 86 includes a grinding spindle 88 which is rotated in the direction of arrow 90 by motor 92.

The grinding wheel 100 may be secured to the spindle 88 in any suitable fashion, for example, the grinding wheel 100 may be mounted to an arbor 102 which in turn secured to the spindle 88.

The grinding wheel 100 may have any suitable size and shape capable of grinding the donor roll 80. For example, the grinding wheel 100 may have a width WW of, for example, 2 inches and a diameter WD of say, for example, 4 to 30 inches. For example, the grinding wheel 100 may have a diameter WD of, for example, 10 inches. The grinding wheel 100 may rotate at any suitable speed in the direction of arrow 90. For example, the grinding wheel 100 may have a rotational speed of, for example, 3000 revolutions per minute (RPM).

The donor roll 80 is preferably rotationally mounted to a headstock 104 and a tailstock 106 by centers 108 extending outwardly therefrom toward the donor roll 80. The grinding machine centers 108 are fitted into centers 110 in the donor roll 80. The donor roll 80 may have any suitable size capable of performing its function in the printing machine (see FIG. 8) but preferably the donor roll 80 has a part diameter PD of, for example, 1.25 inches and a grinding length GL of, for example, 18 inches, as well as a part length PL of, for example, 22 inches.

The machine centers 108 rotate in the direction of arrow 112 with a speed of, for example, 500 RPM and are rotated by motor 114 connected to the centers 108 of the machine 86. While either the headstock 104 and tailstock 106 or conversely, the spindle 88, may translate in a direction parallel to center line 82 preferably, the spindle 88 translates in the direction of arrows 116 and 118, thereby grinding the entire periphery of the donor roll 80. The grinding machine 86 may be any suitable center-type grinder.

Figure 1:
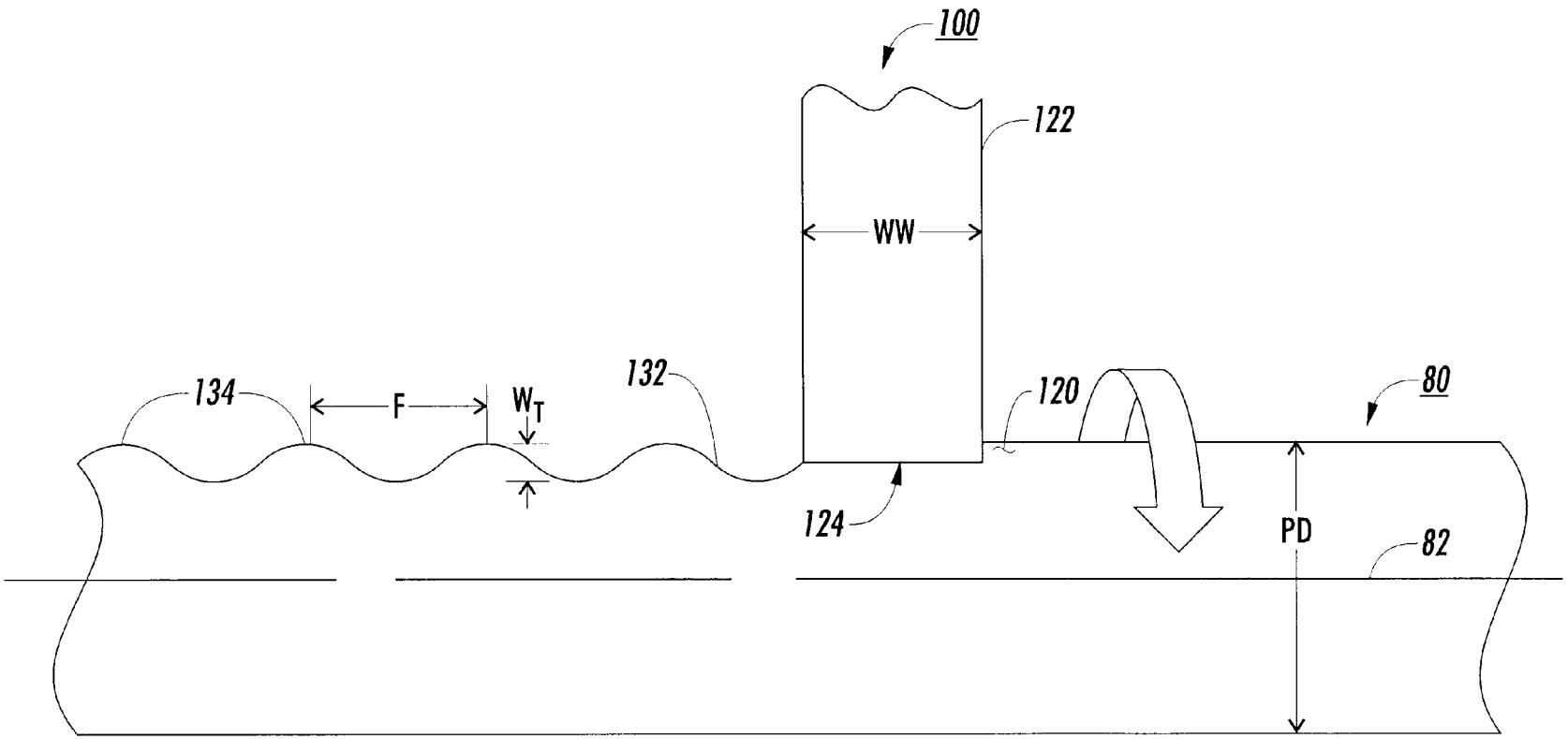
FIG. 1 is a schematic view of the grinding of a roll by a grinding wheel depicting the introduction of noise into the grinding process utilizing a grinding wheel with a geometrical shape according to the present invention.

Referring now to FIG. 1, a grinding process utilizing the grinding wheel 100 with geometric pattern is shown in greater detail. The grinding wheel 100 is a vibration-inducing grinding wheel and is utilized for removing material 120 from a workpiece, for example, roll 80. The vibration-induced grinding wheel 100 is utilized in, for example, the grinding machine 86 (see FIG. 7). The vibration-inducing grinding wheel 100 includes a generally cylindrically shaped body 122 defining a cylindrical outer periphery 124 of the body 122. The outer periphery 124 is, by design, cylindrical, and is generally straight in a direction parallel to center line 82 of the roll 80. The outer periphery 124 of the wheel 100 is formed or shaped by a dressing device so that a true cylindrical outer periphery 124 may be maintained during the grinding process.

Referring again to FIG. 7, a dressing wheel 126 is shown mounted onto dressing wheel spindle 128. The dressing wheel spindle 128 is rotated by, for example, motor 130. The dressing wheel rotates in the direction of arrow 132, at a rotational speed of, for example, 5000 RPM. The dressing wheel 126 dresses the outer periphery 124 of the grinding wheel 100 by having, for example, the spindle 88 move in the direction of arrows 116 and 118 to cover the entire width of the outer periphery 124 of the grinding wheel 100.

It should be appreciated that the grinding wheel 100 may likewise be dressed or conditioned by the use of a single point diamond dressing tool which translates along a direction parallel to center line 82, thereby providing a dressed surface to outer periphery 124 of the grinding wheel 100.

Referring again to FIG. 1, the roll 80 must be manufactured to very exacting tolerances for it's utilization in hybrid scavengeless development. The roll has a ground part diameter PD with a tolerance range of, for example, a few microns. The roll also has a roundness requirement of around 10 to 40 microns maximum total indicator reading as well as a surface finish requirement of a few microns or less.

The general rule of thumb in manufacturing is that, for predicable, successful results, the machine tool must utilize only 10 percent of the part print tolerance. Thus the grinding machine is require to have an ability to provide pieces with a total indicator reading of runout (TIR) of a few microns, a diameter tolerance of less than one micron and surface characteristics of much less than one micron. Such specifications have not yet been achieved in grinding machines by grinding machine manufacturers. In order to compensate for the inherent machine inaccuracies, alternative and innovative manufacturing methods are required.

While the aforementioned tolerances are quite difficult to obtain, a characteristic of the roll 80 which may most simply be called waviness, is even much more difficult to obtain. Periphery 132 of the roll 80 varies in diameter along a direction of the periphery 132 of the roll 80 along a line parallel to the center line 82. This surface variation along the line parallel to the center line 82 may be called waviness in that the surface, when measured in a direction parallel to center line 82, forms a generally sinusoidal wave having an amplitude $W_T$ and a frequency F. For proper operation of the roll 80 in a hybrid scavengeless development, the value of the amplitude $W_T$ from peak to valley of the outer periphery 132 of the roll 80, must be within 1 micron max.

The applicants have discovered that any out-of-roundness of the grinding wheel along with natural frequencies of the machine created by, for example, motors, pumps, filters and general vibrations, transmit themselves through the machine to the interface between the grinding wheel 100 and the roll 80. In addition, the frequencies transmitted through the dressing wheel 126 (see FIG. 7), transmit to the grinding wheel 100 frequencies which results in an out-of-round wheel. The out-of-round wheel in turn adds to the frequency of the machine. This frequency propagates itself in the form of a once around defect to the part of the wheel. The result of the out-of-round condition of the wheel 100 is that irregularities are ground into outer periphery 132 of the roll in the form of lobes 134 and are measured as a surface characteristic of WT. The lobes 134 are a helical series of peaks that repeatedly generate themselves as a result of the grinding wheel and the workpiece helical motion with respect to each other.

Specific frequencies and lobing conditions can be predicted and generated by changing the grinding parameters. The grinding parameters are established by the rotational speed of the wheel 100 and the rotational speed and direction of the workpiece or roll 80.

Specifically, the formula for lobing is:

$L=W_{RPM}/R_{RPM}$ where:

L=number of lobes $W_{RPM}$=grinding wheel revolutions per minute $R_{RPM}$=the workplace revolution per minute The lobes 134 may frequently have a waviness $W_T$ of up to 4 to 5 microns. The phenomenon of the lobes 134 on the roll 80 have been found to coincide with vibrational measurements taken from the wheel 100 and the motors 92, 114 and 130, respectively.

The applicants therefore, have determined that by being able to control the relationship of the wheel to the roll, one can predict and control the frequencies and take positive steps to control the amplitude of the lobes 134.

The applicants have found that one way to take positive steps to add vibration or noise at the position between the outer periphery of the grinding wheel and the outer periphery 132 of the roll 80, which will interact with the once-around frequencies or harmonics of the machine. Some improvement to the waviness may be accomplished by varying the grinding wheel RPM with respect to the roll RPM. The change of the relative speeds of the grinding wheel and the roll introduces added noise at different frequencies and reduces the effectiveness of this approach.

Referring now to FIG. 2, a profile of the outer periphery of a roll is shown measured in a direction parallel with the longitudinal axis of a roll ground on a prior art grinding wheel. The surface condition of the grinding wheel as shown has two components. The first of these components represents the surface finish and is designated by Ra profile or a surface finish profile 136.

As can be seen from FIG. 2, the surface condition also includes an undulating or wavy shaped component and is described by the averaging of the surface finish along the longitudinal axis of the roll. This average or wave profile may be described as a $W_T$ profile 138 or curve 138. The $W_T$ profile 138 has a sinusoidal shape and is defined by a frequency $W_{TF}$ and an amplitude $W_{TA}$. The surface finish profile 136, on the other hand, has an amplitude SFA which is a combination of fairly random variations in the surface finish.

The reduction of the $W_T$ profile 138 is a particularly difficult problem and is caused by the vibration induced by the frequencies of machine motors, pumps, and other known accessories of the grinding machine as well as from the roll and the grinding wheel.

Figure 3:
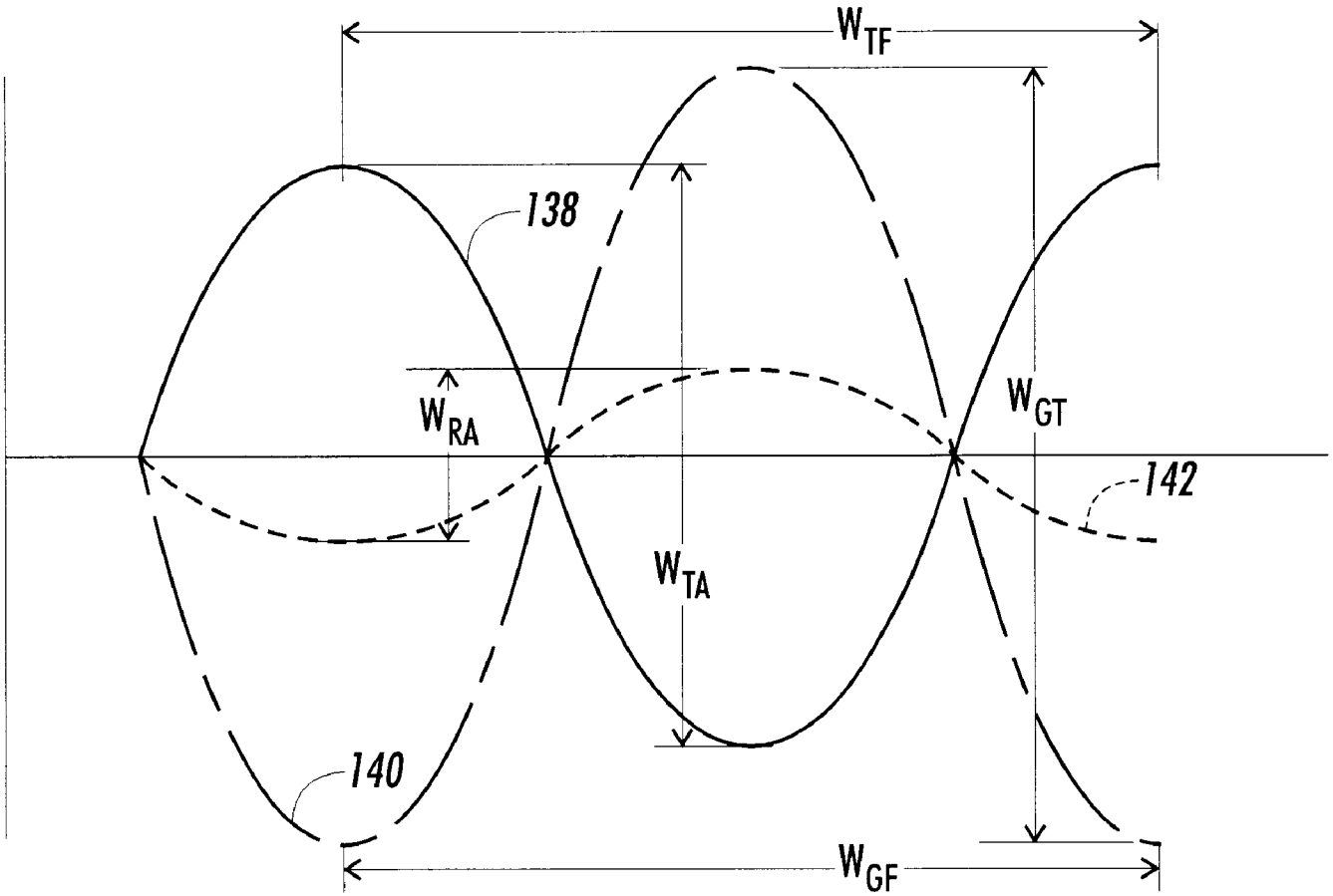
FIG. 3 is a graph of the frequency of vibrations of the grinding machine without the wheel, the frequency of vibrations of the wheel according to the present invention, and resultant frequency of vibrations of the grinding machine with the wheel according to the present invention a grinding wheel with a geometrical shape according to the present invention.

Referring now to FIG. 3, the $W_T$ profile 138 of a standard grinding wheel roll system is shown plotted as a function of amplitude and time. Applicants have discovered that by introducing additional noise or vibration having a selected amplitude and a selected frequency such as by inducing the vibration with a geometrically shaped wheel according to the present invention, the amplitude of the $W_T$ profile may be reduced.

As shown in FIG. 3, a plot of the noise induced by the geometrically shaped wheel is shown graphically as curve 140 shown in phantom is 180° out of phase with profile 138 from a prior art grinding wheel system. The amplitude of the noise induced vibration of curve 140 has a frequency WGF which is substantially equal to the frequency WTF of the standard grinding wheel roll system of curve 138. The noise induced profile of curve 140 has an amplitude WGA which is similar to the amplitude WTA of the standard wheel roll system of curve 138. Thus, the combination of the standard grinding rail system profile 138 and the noise induced profile of curve 140 results in a profile or curve as shown in the dotted line 142 which is much flatter or straighter than the prior art standard grinding wheel profile 138. Applicants have found by the use of the noise inducing grinding wheel, the amplitude resulting from the combination of the profiles 138 and 140 may have an amplitude WRA of 1 micron or less.

It should be appreciated that accelerometers and lasers may be applied to strategic locations on the grinding wheel, workpiece, and machine components to monitor the movement or frequency of the machine during various phases in the grinding process. Through the analysis of the accelerations and movements, the out-of-roundness of the grinding wheel along with natural frequencies of the machine created by the motors, pumps, filters and general vibration that transmit themselves through the machine to the interface between the grinding wheel and the workpiece. It should be appreciated that the pattern or irregularities in the grinding wheels can be selected so as to counteract the frequency of the standard grinding wheel profile as shown as curve 138 (see FIG. 3).

Noise or vibrations can be induced by the grinding wheel through the application of a pattern placed on the cylindrical outer periphery of the grinding wheel. Referring now to FIG.

4, the grinding wheel 100 may include a series of sinusoidal patterns on outer periphery 124 of the grinding wheel 100. The grinding wheel 100 includes at least one groove 144 formed in the outer periphery 124. The groove 144 may have any suitable shape and may, for example, have a arcuate or curved shape. For example, the groove 144 may have a sinusoidal shape. The groove 144 may have a width GW of say, for example, 0.5 millimeters and may have any suitable groove depth of, for example, 0.5 millimeters.

While a solitary groove 144 may be sufficient to practice the invention, preferably, a plurality of grooves 144 are formed in the grinding wheel 100. The grooves 144 may have a generally sinusoidal shape defined by a groove frequency GF of say, for example, 7.0 millimeters and a groove amplitude GA of say, for example, 3 millimeters. The grooves 144 may intersect each other or may, as shown in FIG. 3, include a gap 146 between adjacent grooves 144. While a solitary row of grooves 144 may be sufficient as shown in FIG. 4, a first set 148 and a second set of grooves 150 may be placed with a distance W prime spacing the adjacent grooves 144 from each other.

Figure 4:
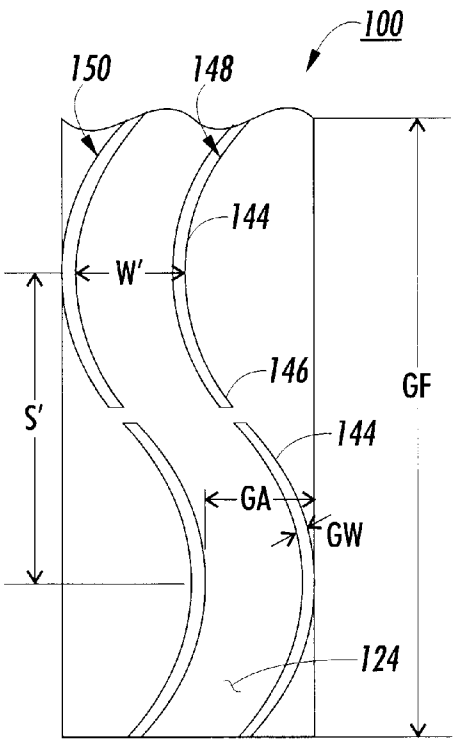
FIG. 4 is a partial plan view of a first embodiment of a grinding wheel with a geometrical shape according to the present invention, showing a wheel with a sinusoidal shape.

While as shown in FIG. 4, the grinding wheel 100 includes grooves 144, it should be appreciated that the invention may be performed with lands or raised portions in the place of the grooves. If lands rather than grooves are used preferably the lands have substantial widths such that grinding wheel wear is not unmanageable.

Figure 5:
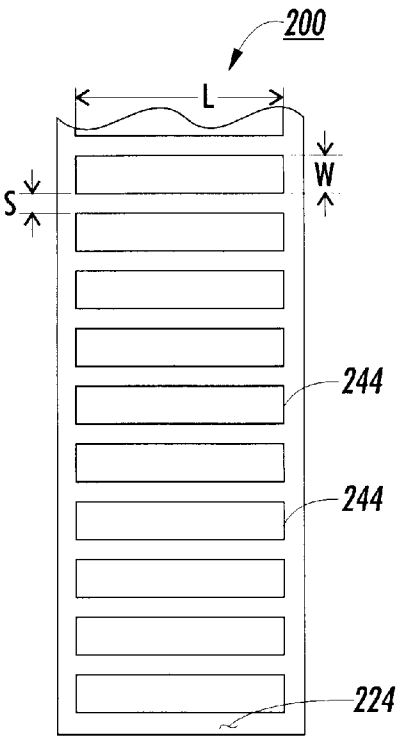
FIG. 5 is a partial plan view of a second embodiment of a grinding wheel with a geometrical shape according to the present invention, showing a wheel with a hatched shape.

Referring now to FIG. 5, a grinding wheel with geometric pattern according to the present invention is shown as grinding wheel 200. Grinding wheel 200 includes rectangularly shaped grooves or hatches 244. While a solitary hatch 244 may be utilized, preferably, a pattern of hatches 244 are used. The hatch 244 may have any suitable shape and may, for example, have a length L of, for example, 10 millimeters and a width W of, for example, 3 millimeters. Adjacent hatches 244 may be spaced apart by a spacing S of, for example, 3 millimeters. The hatches 244 may have a depth of, for example, 2 millimeters. It should be appreciated that the quantity and spacing of the hatches 244 is selected to impart a noise into the grinding machine and roll such that the amplitude of the waviness of the roll is reduced.

While the invention may be practiced with a grinding wheel with a hatched area 244, it should be appreciated that the invention may be practiced with a grinding wheel having a rectangular area similar to the hatched area 244 with the rectangular area being a raised, rather than a recessed, area.

Figure 6:
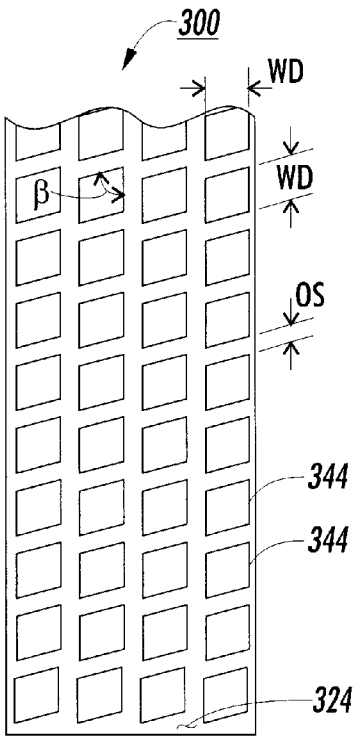
FIG. 6 is a partial plan view of a third embodiment of a grinding wheel with a geometrical shape according to the present invention, showing a wheel with a diamond shape.

Referring now to FIG. 6, a alternate embodiment of a grinding wheel with geometric pattern of the present invention is shown as grinding wheel 300. The grinding wheel 300 includes at least one diamond 344 located on outer periphery 324 of the wheel 300. While a solitary diamond 344 may be sufficient, preferably a plurality of diamonds 344 are positioned on the outer periphery 324 of the grinding wheel 300. The diamonds 344 may have any suitable size and shape and may, for example, have a width WD of say, for example, 2 millimeters. The diamonds 344 may be defined by an included angle β of, for example, 80°. Adjacent diamonds 344 may be separated by a distance of, for example, OS of 2 millimeters. The diamonds 344 may have a height of, for example, 1 millimeter. It should be appreciated that the dimensions WD and OS as well as the height, the quantity and the placement of the diamonds 344 should be selected so as to induce a noise into the grinding machine to cancel the effects of the machine and component noise to thereby reduce the waviness of the roll produced on the grinding machine.

The geometric shapes shown in FIGS. 4–6 may be formed onto a aluminum oxide or silicon carbide grinding wheel by the use of a single point diamond dressing attachment or by the use of a rotary diamond dresser attachment. It should be appreciated that the grinding wheel would preferably be stopped and indexed during the performance of the shaping of the grinding wheel. It should be also appreciated that the shapes on the grinding wheels of FIGS. 4–6 may be produced by the use of commonly available, standard, tool sharpening equipment.

While the grinding wheel may be made of aluminum oxide or silicon carbide, the grinding wheel may also be made of a diamond. When making a diamond grinding wheel having the geometrical pattern of FIGS. 4–6, preferably the substrate of the diamond grinding wheel is made of a softer material than the diamond material of the outer surface of the wheel and the substrate may be machined by similar methods available for sharpening cutting tools. The geometrically shaped grinding wheel substrate is then plated with the diamond material in order to complete a geometrically shaped diamond grinding wheel.

Figure 9:
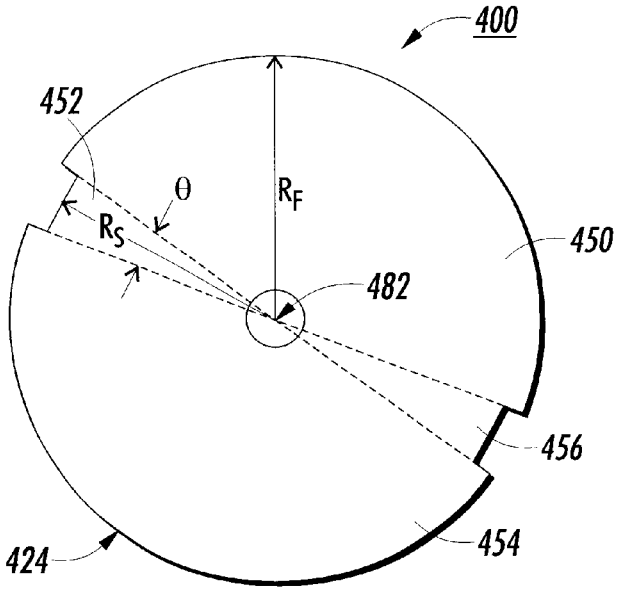
FIG. 9 is a plan view of a fourth embodiment of a grinding wheel with a geometrical shape according to the present invention, showing a wheel with portions having different outer diameters.

Referring now to FIG. 9, an alternate embodiment of a vibration inducing grinding wheel is shown as grinding wheel 400. The grinding wheel 400 includes a first portion 450 which has an outer periphery 424 defined by a first radius $R_F$ extending from rotational axis 482 of the wheel 400. The wheel 400 further includes a second portion 452. The second portion 452 is defined by a second radius $R_S$ extending from the rotational axis 482 of the wheel 400. The second radius $R_S$ is different than the first radius $R_F$.

For example the radius $R_F$ may be six inches and the radius $R_S$ may be 5.9 inches. The small portion 452 may be defined by an angle θ of, for example, 2°. While the present invention may be practiced with the wheel 400 including only a first and a second portion 450 and 452 respectively, preferably, to provide for a balanced wheel 400, the wheel 400 further includes a third portion 454 similar to first portion 450 as well as a fourth portion 456 similar to second portion 452.

Figure 10:
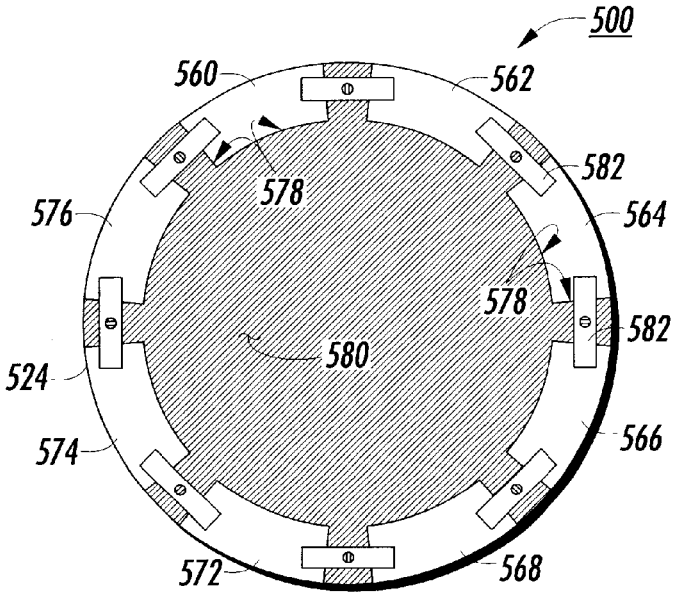
FIG. 10 is a plan view of a fifth embodiment of a grinding wheel with a geometrical shape according to the present invention, showing a wheel with segments having different compositions.

Referring now to FIG. 10, a vibration inducing grinding wheel according to the present invention is shown as grinding wheel 500. Grinding wheel 500 includes at least a first portion 560 and a second portion 562. The first portion 560 is made from a different composition than the second portion 562. For example, the first portion 560 may be made of a material including, for example, 80 grit abrasive while the second portion 562 may be made of a second material including an abrasive of 120 grit. The different sizes of the abrasive grit in the first portion 560 and 562 grind the roll differently and may serve to induce the noise necessary for a vibration-induced in grinding wheel according to the present invention.

While the invention may be practiced with a grinding wheel 500 including only a first portion 560 and a second portion 562, preferably the grinding wheel 500 includes a larger number of portions. For example, in addition to the first portion 560 and second portion 562, a third portion 564, a fourth portion 566, a fifth portion 568, a sixth portion 572, a seventh portion 574, as well as an eighth portion 576 may be included. Each of the eight portions 560–576 may be made of a different material or a material with a different abrasive grit size. Alternatively, adjacent segments may be made of different materials with alternating segments having similar compositions. The different portions, 560–576, may be made by bonding portions of different grinding wheels or by adding different abrasive grits to different portions of the wheel during the manufacture of the grinding wheel.

Alternatively, the grinding wheel 500 as shown in FIG. 10, includes pockets 578 for placing the portions 560–578.

The pockets 578 may be formed in a arbor 580 and the segments 560–576 may be secured to the arbor 580 by the use of clamps 582.

Referring again to FIG. 3, the profile 142 may be measured or described as the straightness of the roll 80. Straightness may be defined as a deviation from a straight line parallel and spaced from longitudinal center line 82 of the roll 80 (see FIG. 7).

Referring again to FIG. 3, the RA profile or surface finish profile 136 is subtracted or negated in determining the $W_T$ profile 138 or the straightness of the roll 80.

Anyone of the grinding wheels 100, 200, 300, 400 or 500 may be utilized to grind the cylindrical periphery 124 of the roll 80. The roll 80 may be ground on any grinding machine 86 capable of accepting a vibration-induced grinding wheel such as that of grinding wheel 100, 200, 300, 400 or 500.

The method for grinding the cylindrical periphery of the roll includes the steps of providing the vibration-inducing grinding wheel with a generally cylindrically shaped body and which defines the cylindrical outer periphery thereof. The vibration-induced grinding wheel is designed to provide for a vibration of the grinding machine such that the runout of the roll is improved in comparison to the runout of a roll ground by a standard grinding wheel having a cylindrical outer periphery and having a contour and composition of the outer periphery of the standard grinding wheel which is uniform.

A vibration-inducing grinding wheel may be created by either providing for a variation in the composition of the outer periphery portion of the grinding wheel or by varying the contour of the outer periphery of the grinding wheel. Experimentation may be required to elect either the composition or the contour which best reduces the waviness or improves the straightness of a roll ground therefrom. The vibration-induced grinding wheel is rotatably mounted to the grinding machine. The roll is placed adjacent the grinding machine in a rotatable position. The workpiece and the grinding wheel are caused to advanced toward each other into contact with each other.

The roll is ground with the vibration-inducing grinding wheel such that the waviness or straightness of the roll is improved with respect to the straightness of a roll ground by a standard grinding wheel having a cylindrical outer periphery in which the contour and composition of the outer periphery of the standard grinding wheel is uniform.

Referring again to FIG. 7, the method of grinding a roll with the vibration-inducing grinding wheel of the present invention may include optimization steps to optimize the selection of the grinding wheel and/or the grinding parameters to minimize vibration. The method of grinding a roll with the vibration-induced grinding wheel may include the steps of measuring the vibrations applied by the vibration-inducing grinding wheel onto the roll with a sensor 170. A signal 172 is sent to a controller 174 which, in turn, sends a signal 176 to spindle motor 92 which adjusts the speed of the grinding wheel 100. The controller 174 receives the signal 172 which is indicative of the vibrations applied by the vibration-inducing grinding wheel 100 onto the roll 80. The controller 174 sends a signal 176 to the grinding machine motor 92 indicative of the speed of the grinding wheel 100 necessary to counteract the vibrations applied by the vibration-inducing grinding wheel 100 onto the roll 80.

By providing a vibration-inducing grinding wheel, which induces vibrations which cancel out the vibrations of the grinding process, a lower waviness or improved straightness of the roll is provided.

By providing a vibration-inducing grinding wheel which cancels the vibration induced in the grinding process, deeper cuts and reduced grinding times are capable for the grinding process.

By providing a vibration-inducing grinding wheel which cancels the vibrations induced during the grinding process, improved grinding wheel lives and reduced stress may be possible.

By providing a vibration-induced grinding wheel including portions of the grinding wheel made of different materials, a vibration may be induced into the grinding wheel to cancel that from the grinding process such that the straightness of the roll may be improved.

By providing a vibration-inducing grinding wheel including a modified contour, a vibration may be induced into the grinding process to cancel the vibrations of the grinding process and thereby improve the waviness of a roll produced by the vibration-inducing grinding wheel.

By providing a feedback system to monitor the vibrations induced into the grinding process and to adjust the grinding wheel thereby to minimize the vibrations of the grinding process, the straightness and surface condition of a roll made by a vibration-induced grinding wheel may be improved.

By selecting a grinding wheel so as to provide a vibration to the grinding machine which cancels the vibrations otherwise induced in the grinding process, the straightness of the roll may be improved with respect to the straightness of a roll ground by a standard grinding wheel having a cylindrical outer periphery.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A method for grinding a cylindrical periphery of cylindrical workpieces on a grinding machine, comprising:

providing a vibration inducing grinding wheel with a generally cylindrically shaped body defining a cylindrical outer periphery thereof with a composition and a contour adapted to induce a first noise into at least one of the grinding machine and the workpiece, the first noise of the vibration inducing grinding wheel having an amplitude and a frequency out of phase from at least one of a second noise from the grinding machine and a third noise from the workpiece;

rotatably mounting the vibration inducing grinding wheel to the grinding machine;

placing the workpiece adjacent the grinding machine in a rotatable position;

advancing one of the workpiece and the vibration inducing grinding wheel into contact with the other of the workpiece and the grinding wheel; and grinding the workpiece with the vibration inducing grinding wheel such that the first noise from the vibration inducing grinding wheel causes a reduction in at least one of the second noise and the third noise whereby the outer periphery of the vibration inducing grinding wheel forms a substantially cylindrical surface over the length of the workpiece.

2. The method according to claim 1, further comprising selecting a pattern on the cylindrical outer periphery of the wheel for inducing vibration to the grinding machine.

3. The method according to claim 2 wherein the pattern comprises at least one of a sinusoidal pattern, a diamond pattern, and a hatched pattern.

4. The method according to claim 1, wherein providing the vibration inducing grinding wheel comprises providing a first portion of the outer periphery of the vibration inducing grinding wheel with a first radius extending from a rotational axis of said wheel and a second portion of the outer periphery of the vibration inducing grinding wheel with a second radius extending from the rotational axis of said wheel, said second radius being different than said first radius.

5. The method according to claim 1, wherein providing a vibration inducing grinding wheel comprises providing a plurality of portions on the grinding wheel, at least two of the portions being made of different compositions from each other.

6. The method according to claim 1, further comprising:

measuring vibrations applied by the vibration inducing grinding wheel onto the workpiece with a sensor; and controlling the speed of the wheel by receiving a signal from the sensor indicative of the vibrations applied by the vibration inducing grinding wheel onto the workpiece and by sending a signal to the grinding machine indicative of the speed of the wheel necessary to counteract the vibrations applied by the vibration inducing grinding wheel onto the workpiece.

7. The method according to claim 1 further comprising providing the vibration inducing grinding wheel with an outer periphery that varies in at least one of the composition, and contour, and structure.

8. The method according to claim 7 wherein the vibration inducing grinding wheel comprises at least one of aluminum oxide, silicone carbide, and diamond.

9. The method according to claim 1 further comprising forming the contour of the outer periphery to provide an outer periphery adapted to induce vibration to the grinding machine such that the distance from one or more peaks to one or more valleys of the workpiece is less than about 1 micron.

10. The method according to claim 1 further comprising providing a motor for rotating the vibration inducing grinding wheel.

11. The method according to claim 10 further comprising providing a sensor for measuring vibrations during the grinding process and a controller for controlling the motor associated with the vibration inducing grinding wheel.

12. The method according to claim 1 wherein the vibration inducing grinding wheel comprises a plurality of segments thereof, each of said segments being different from each other.

13. A roll made by a process comprising:

providing a vibration inducing grinding wheel with a generally cylindrically shaped body defining a cylindrical outer periphery thereof with a composition and a contour adapted to induce a first noise into at least one of a grinding machine and a workpiece, the first noise of the vibration inducing grinding wheel having an amplitude and a frequency out of phase from at least one of a second noise from the grinding machine and a third noise from the workpiece;

rotatably mounting the vibration inducing grinding wheel to the grinding machine;

placing the workpiece adjacent the grinding machine in a rotatable position;

advancing one of the workpiece and the vibration inducing grinding wheel into contact with the other of the workpiece and the grinding wheel; and grinding the workpiece with the vibration inducing grinding wheel such that the first noise from the vibration inducing grinding wheel causes a reduction in at least one of the second noise and the third noise whereby the outer periphery of the vibration inducing grinding wheel forms a substantially cylindrical surface over the length of the workpiece.

14. The roll made by the process according to claim 13, further comprising:

measuring vibrations applied by the vibration inducing grinding wheel onto the workpiece with a sensor; and controlling the speed of the wheel by receiving a signal from the sensor indicative of the vibrations applied by the vibration inducing grinding wheel onto the workpiece and by sending a signal to the grinding machine indicative of the speed of the wheel necessary to counteract the vibrations applied by the vibration inducing grinding wheel onto the workpiece.

* * * * *